US011597571B2

(12) United States Patent
Tamarindo

(10) Patent No.: US 11,597,571 B2
(45) Date of Patent: Mar. 7, 2023

(54) CLOSURE FOR A THIN-WALLED FLEXIBLE PACKAGING

(71) Applicant: GUALA PACK S.P.A., Alessandria (IT)

(72) Inventor: Stefano Tamarindo, Alessandria (IT)

(73) Assignee: Guala Pack S.P.A., Alessandria (IT)

( * ) Notice: Subject to any disclaimer, the term of this patent is extended or adjusted under 35 U.S.C. 154(b) by 0 days.

(21) Appl. No.: 17/614,166

(22) PCT Filed: Apr. 22, 2020

(86) PCT No.: PCT/IB2020/053803
§ 371 (c)(1),
(2) Date: Nov. 24, 2021

(87) PCT Pub. No.: WO2020/240294
PCT Pub. Date: Dec. 3, 2020

(65) Prior Publication Data

US 2022/0250816 A1 Aug. 11, 2022

(30) Foreign Application Priority Data

May 29, 2019 (IT) ..... 102019000007497

(51) Int. Cl.
*B65D 55/16* (2006.01)
*B65D 41/34* (2006.01)
*B65D 75/58* (2006.01)

(52) U.S. Cl.
CPC ..... *B65D 55/16* (2013.01); *B65D 41/3447* (2013.01); *B65D 75/5883* (2013.01); *B65D 2251/02* (2013.01); *B65D 2401/30* (2020.05)

(58) Field of Classification Search
CPC ..... B65D 41/3452; B65D 43/0283; B65D 2251/02
See application file for complete search history.

(56) References Cited

U.S. PATENT DOCUMENTS

| | | | | |
|---|---|---|---|---|
| 5,215,204 | A | 6/1993 | Beck et al. | |
| 5,755,346 | A * | 5/1998 | Ekkert | B65D 41/3447 215/901 |
| 6,931,821 | B2 * | 8/2005 | Wong | B65D 55/16 215/250 |
| 9,751,677 | B2 | 9/2017 | Fiere et al. | |
| 10,421,593 | B1 * | 9/2019 | Litten | B65D 55/16 |
| 2008/0197135 | A1 | 8/2008 | Berman | |
| 2011/0174760 | A1 | 7/2011 | Luzzato et al. | |

(Continued)

FOREIGN PATENT DOCUMENTS

| | | |
|---|---|---|
| KR | 2018 0109233 A | 10/2018 |
| WO | WO 2013/176917 | 11/2013 |

OTHER PUBLICATIONS

International Search Report and Written Opinion, dated Jul. 14, 2020, for the corresponding International Application No. PCT/IB2020/053803 in 10 pages.

(Continued)

*Primary Examiner* — Mollie Impink
(74) *Attorney, Agent, or Firm* — Polsinelli PC

(57) ABSTRACT

A closing assembly for a spout with tube for a thin-walled flexible packaging includes a cap and a connecting device comprising a strap and a guarantee seal provided with breakable bridges.

20 Claims, 12 Drawing Sheets

(56) References Cited

U.S. PATENT DOCUMENTS

| | | | | |
|---|---|---|---|---|
| 2011/0210122 | A1* | 9/2011 | Benoit-Gonin .... | B65D 75/5883 220/277 |
| 2017/0121084 | A1 | 5/2017 | Moorehouse | |

OTHER PUBLICATIONS

Notification of Transmittal of the International Preliminary Report on Patentability, dated Oct. 5, 2021, for the corresponding International Application No. PCT/IB2020/053803 in 6 pages.
Italian Search Report, dated Feb. 21, 2020, for the corresponding Italian Application No. 102019000007497 in 2 pages.

* cited by examiner

CLOSURE FOR A THIN-WALLED FLEXIBLE PACKAGING

The present invention relates to the field of flexible thin-walled packaging, usually called "pouches", and in particular to the field of packaging provided with a spout for spilling the product.

These packages are now widespread and used above all for containing products for children, such as fruit juices and purées, yoghurt, vegetable purée and drinks. The enormous diffusion known by this packaging is attributable to the great convenience of use and ease of use by children, as well as the playful component linked to the use of the spout and the need to squeeze the packaging to allow the product to come out.

Currently, hundreds of millions of flexible packaging with spout are produced worldwide.

As is the case for many other consumer goods, even in the field of flexible packaging with spout there is an important research and development effort by producers, in order to produce and market a product which respects the environment, as well as being able to meet the needs mentioned above.

In this regard, one of the most felt drawbacks in the field is that the cap that closes the spout, once unscrewed, may be inadvertently lost by the user, due to its small size, or badly thrown away, without proceeding with proper disposal.

The object of the present invention is to provide a closing assembly for a spout assembly for a thin-walled flexible packaging which overcomes the drawbacks mentioned above and meets the needs of the sector.

Such an object is achieved by a closing assembly made according to claim 1; the dependent claims describe further advantageous embodiments of the invention.

The features and the advantages of the closing assembly according to the present invention will appear more clearly from the following description, made by way of an indicative and non-limiting example with reference to the drawings of the accompanying figures, in which:

FIG. 1*a* shows a spout assembly according to the present invention, in an initial configuration with screwed cap;

FIG. 1*b* shows the spout assembly of FIG. 1*a* in an intermediate opening configuration with unscrewed cap;

FIG. 1*c* shows the spout assembly of FIG. 1*b* in a final opening configuration with the cap unscrewed and overturned;

FIG. 2*a* shows a side view of a closing assembly, consisting of a cap and a connection device, according to an embodiment variant of the invention;

FIG. 2*b* shows an enlargement of box J of FIG. 2*a;*

FIG. 2*c* shows a section of the assembly of FIG. 2*b*, according to the section plane K-K of FIG. 2*b;*

FIG. 2*d* shows a section of the assembly of FIG. 2*b*, according to the section plane L-L of FIG. 2*b;*

FIG. 2*e* shows a strap of the assembly of FIG. 2*a;*

FIG. 3*a* shows a side view of a closing assembly, according to a further embodiment variant of the invention;

FIG. 3*b* shows an enlargement of box M of FIG. 3*a;*

FIG. 3*c* shows a section of the assembly of FIG. 3*b*, according to the section plane N-N of FIG. 3*b;*

FIG. 3*d* shows a section of the assembly of FIG. 3*b*, according to the section plane P-P of FIG. 3*b;*

FIG. 3*e* shows a strap of the assembly of FIG. 3*a;*

FIG. 4*a* shows a side view of a closing assembly, according to a further embodiment variant of the invention;

FIG. 4*b* shows an enlargement of box R of FIG. 4*a;*

FIG. 4*c* shows a section of the assembly of FIG. 4*b*, according to the section plane T-T of FIG. 4*b;*

FIG. 4*d* shows a section of the assembly of FIG. 4*b*, according to the section plane U-U of FIG. 4*b;*

FIG. 4*e* shows a strap of the assembly of FIG. 4*a;*

FIG. 5*a* shows a side view of a closing assembly, according to a further embodiment variant of the invention;

FIG. 5*b* shows an enlargement of the box V of FIG. 5*a;*

FIG. 5*c* shows a section of the assembly of FIG. 5*b*, according to the section plane W-W of FIG. 5*b;*

FIG. 5*d* shows a section of the assembly of FIG. 5*b*, according to the section plane Y-Y of FIG. 5*b;*

FIG. 5*e* shows a strap of the assembly of FIG. 5*a;*

Figure 14A:
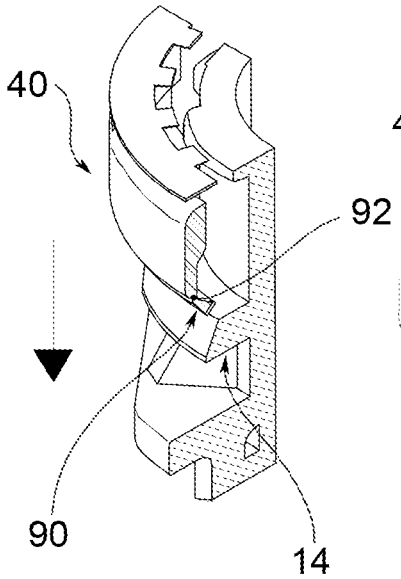
Figure 14B:
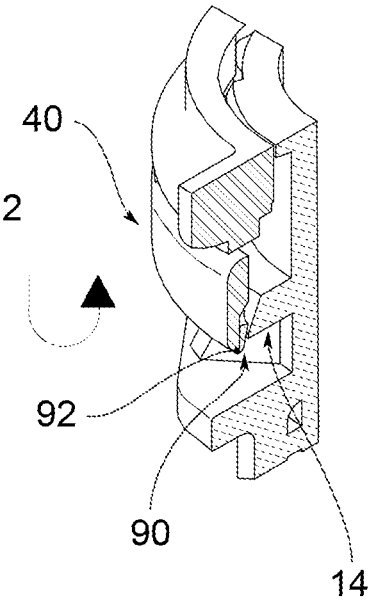
Figure 14C:
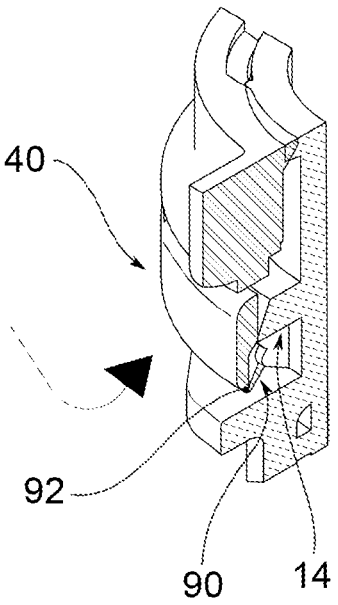

FIGS. 14*a*, 14*b* and 14*c* show sectional views of a ring and a spout according to a further embodiment of the present invention.

According to the present invention, a thin-walled flexible packaging (not shown) comprises a flexible bag having at least one front wall and one rear wall, made from a thin film, joined together along peripheral edges by a weld. Above, between the upper edge of the front wall and the upper edge of the rear wall, a spout is applied for the release of the product contained in the packaging; the spout is closed by a cap.

According to a further embodiment, the bag comprises a first side wall, welded between the first side edges of the front wall and the rear wall, for example on a first side; according to an even further embodiment, the bag comprises a second side wall, welded between second side edges of the front wall and the rear wall, for example on a second side.

According to an even further embodiment, the bag comprises a bottom wall, welded between the lower edges of the front wall and the rear wall, to make a base for the packaging.

The thin film is monolayer or multilayer; permeable to oxygen or impermeable to oxygen.

According to the figures of the accompanying tables, reference numeral 1 generally indicates a spout assembly comprising the spout 2, a cap 4 screwable to the spout 2 and a connection device 6 for the permanent connection between the cap 4 and the spout 2.

The spout 2, from a lower end towards an upper end, comprises a connecting portion 8, generally called "welding rim", intended to be applied between the upper edges of the front wall and the rear wall of the bag, a connecting plate 10, which delimits the connecting portion 8 at the top, a lower flange 12, axially spaced from the lower plate 10, and an upper flange 14, axially spaced from the lower flange 12.

An annular connection seat 15 is therefore formed between the lower flange 12 and the upper flange 14, which will be discussed later.

The spout 2 further comprising a tube 16, protruding axially from the upper flange 14, ending with a tube edge 18 which peripherally delimits an outlet opening 20 for the product to come out of the packaging. The tube 16 extends along a main axis X and externally has a thread 22 for engaging the spout 2 with the cap 4.

The spout 2 also has an inner duct 24, coaxial with the main axis X, which extends from the outlet opening 20 to the connecting portion 8 or, in an embodiment variant, below it.

The spout 2 is made of a single piece of plastics material, for example by injection molding.

According to a preferred embodiment (FIGS. 7 to 10), the upper flange 14 is circular, but has on the outer side surface, preferably truncated-cone, a pair of flat facets 51, parallel to each other. Each facet 51 lies on an imaginary plane parallel to the main axis X of the tube 16.

Advantageously, said facets 51 reduce the diametrical dimensions of the upper flange 14 in a predefined direction parallel to said imaginary planes and orthogonal to the main axis X, from a maximum diameter of the upper flange Dmax (which will be discussed later) to a distance D' between said facets 51.

For example, the distance D' is reduced between 3 and 5% with respect to the diameter Dmax, preferably by 3.5%.

According to a further aspect, the cap 4 comprises an annular side wall 30, which extends around a main axis Y of the cap 4, between an upper cap edge 32 and a lower cap edge 33, and a base 34 which closes it at the top, connected to said upper cap edge 32.

The side wall 30 of the cap 4 is internally threaded for screwing to the tube 16 of the spout 2.

At the bottom, the cap 4 comprises a cap flange 36, projecting radially externally from the bottom edge of the cap 33 and having a free lower surface 37, for example in the form of a flat circular crown.

The connection device 6 comprises a connecting element or ring 40, axially constrained to the spout 2, for example at least partially arranged in the connection seat 15, between the lower flange 12 and the upper flange 14, which may freely rotate in said connection seat 15.

The ring 40 has a predefined axial height, between a lower surface 42, for example in the form of a flat circular crown, and an upper surface 44, for example rounded, which, when the cap 4 is screwed to the spout 2, faces the lower surface 37 of the cap flange 36.

The ring 40 also has an inner side surface 40*i* and an outer side surface 40*e*, comprised between the lower surface 42 and the upper surface 44.

Figure 11:
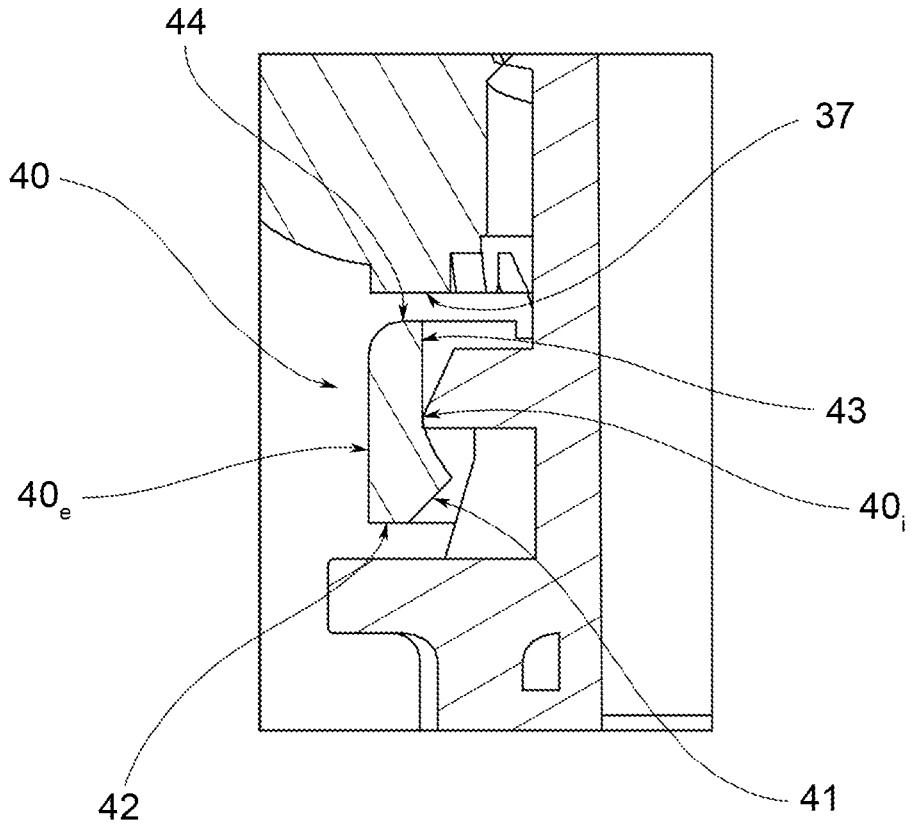
FIGS. 11, 12 and 13 show sectional views of a ring and a spout according to an embodiment of the present invention.

According to a preferred embodiment (FIG. 11), on the inner side surface 40*i*, the ring 40 has an inner projection 41, projecting radially internally with respect to a remaining area 43 of the inner side surface 40*i*.

The inner projection 41 has an axial height Hr on the inner side surface 40*i* and a radial height Sr with respect to the remaining area 43.

Preferably, the ratio R1 of the axial height Hr to the radial height Sr (R1=Hr/Sr) is between 2 and 5, preferably between 3 and 4, preferably equal to 3.5.

Figure 12:
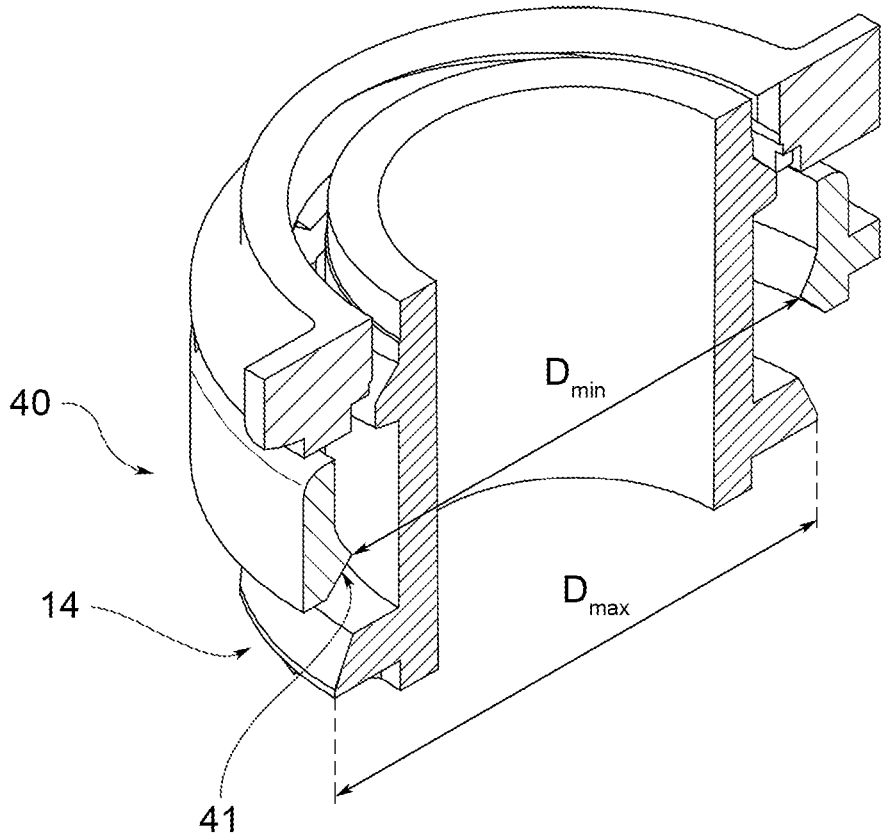

The upper flange 14 of the spout 2 has a maximum diameter Dmax and the inner projection 41 of the ring 40 has a minimum diameter Dmin, measured at the apex of said inner projection 41 (FIG. 12).

Preferably, the ratio R2 of the maximum diameter Dmax of the upper flange 14 to the minimum diameter Dmin of the inner projection 41 (R2=Dmax/Dmin) is between 0.9 and 1.2, preferably between 1.0 and 1.1, preferably equal to 1.05.

Figure 13:
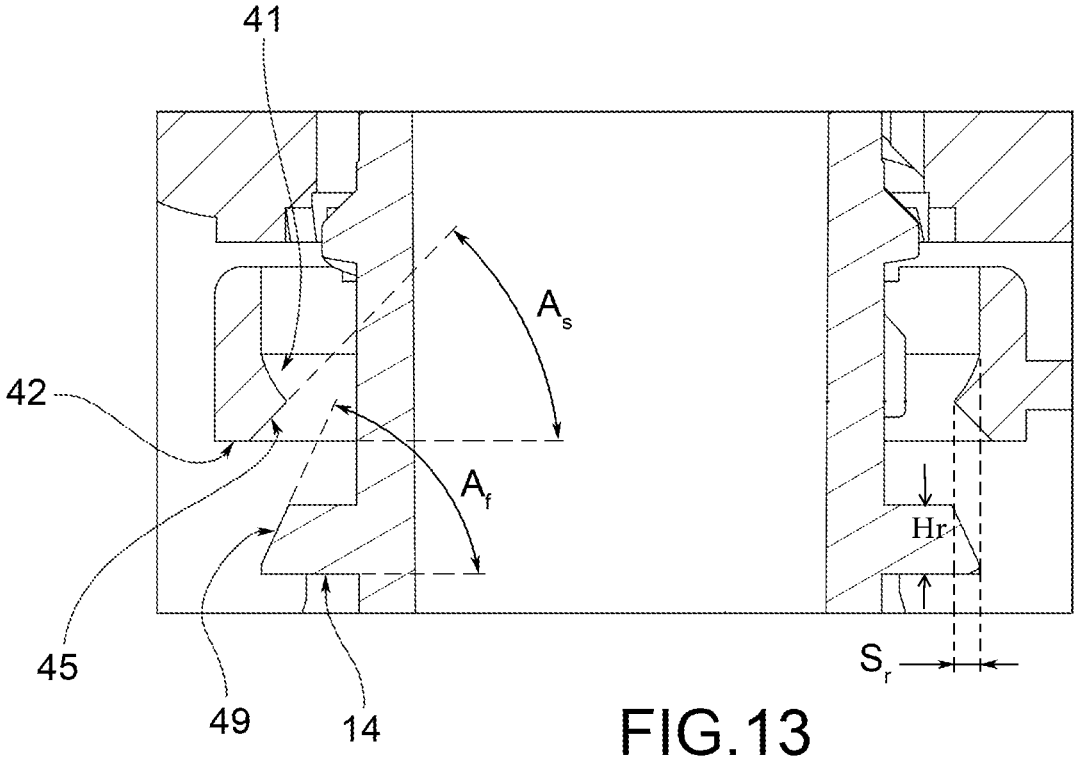

According to a preferred embodiment (FIG. 13), the inner projection 41 has, towards the lower surface 42, an annular chamfer surface 45, which forms a recess for the snap application of the ring 40 in the connection seat 15 of the spout 2.

Preferably, the chamfer surface 45 is truncated-cone and is inclined by an angle As with respect to an imaginary plane orthogonal to the central axis of the ring 40. For example, the angle As is comprised between 40 and 50°, preferably between 44 and 46°, equal to about 45°.

Preferably, moreover, the upper flange 14 is chamfered so as to form a recess for the snap application of the ring 40 in the connection seat 15 of the spout 2.

The upper flange 14 therefore has a truncated-cone chamfer surface 49, inclined by an angle Af with respect to an imaginary plane orthogonal to the central axis of the spout 2. For example, said angle Af is comprised between 60 and 70°, preferably between 63 and 67°, preferably equal to 65°.

Advantageously, for greater safety of the assembly, the dimensional proportions indicated above allow the ring to remain attached to the spout even if the user, generally a child, pulls the cap in an attempt to separate it from the spout.

According to a further aspect, the connecting device further comprises a plurality of breakable bridges 46 which, when intact, join the ring 40 to the cap 4, and in particular the ring 40 to the cap flange 36.

According to a preferred embodiment, said bridges 46 join the upper surface 44 of the ring 40 to the lower surface 37 of the cap flange 36.

The connecting device further comprises a flexible connection band or strap 50, having a predominant extension along a dimension which constitutes the length thereof, between a ring end 52, joined to the ring 40, and in particular to the outer side surface thereof, and a cap end 54, joined to the cap 4, and in particular to the cap flange 36, and preferably to the outer side surface thereof.

Said strap 50 has a ring section 50*a*, which extends from the ring end 52 and is preferably straight, a cap section 50*b*, which extends from the cap end 54 and is preferably straight, and a connection section 50*c*, typically arched, which joins the cap section 50*b* and the ring section 50*a*.

The cap 4 and the connecting device 6 together form a closing assembly 100 and are made as a single piece of plastics material, for example by injection molding.

Figure 1A:
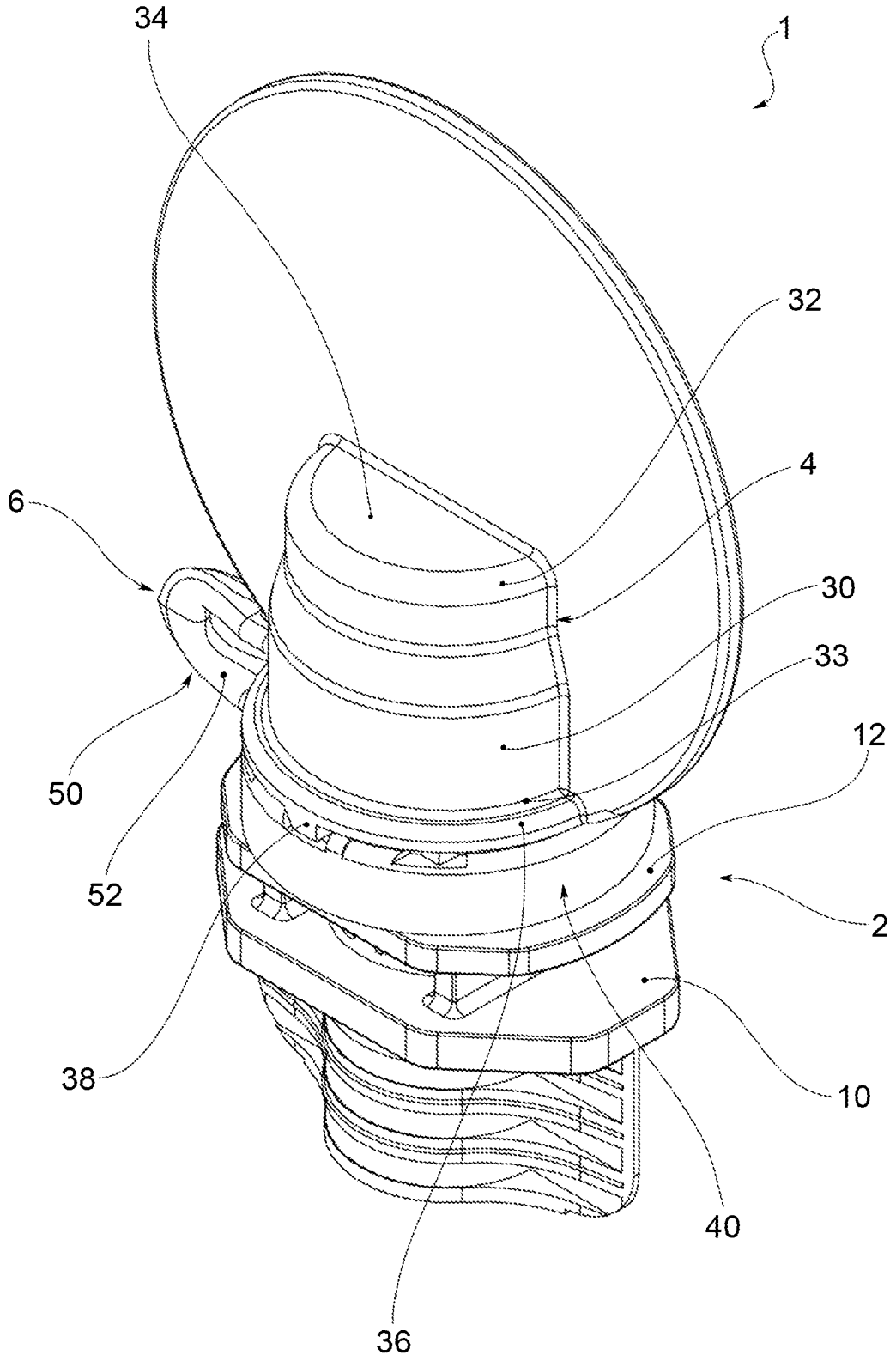

In an initial configuration (FIG. 1*a*), the cap 4 is screwed to the tube 16 of the spout 2, the ring 40 is arranged in the connecting seat 15, axially constrained to the spout 2 and free to rotate in said connecting seat 15, and the bridges 46 are intact and join the ring 40 to the cap flange 36.

By unscrewing the cap 4 from the spout 2, this drags the ring 40 in rotation and at the same time moves axially on the tube 16, causing the bridges 36 to break.

Once the unscrewing is completed (FIG. 1*b*), the inner duct 24 of the spout 2 is accessible through the outlet opening 20, the bridges 36 are broken, as evidence of the tampering, and the cap 4 remains connected to the spout 2, by virtue of the strap 50 which continues to join the cap 4 to the ring 40, which in turn is constrained to the spout 2.

Figure 1B:
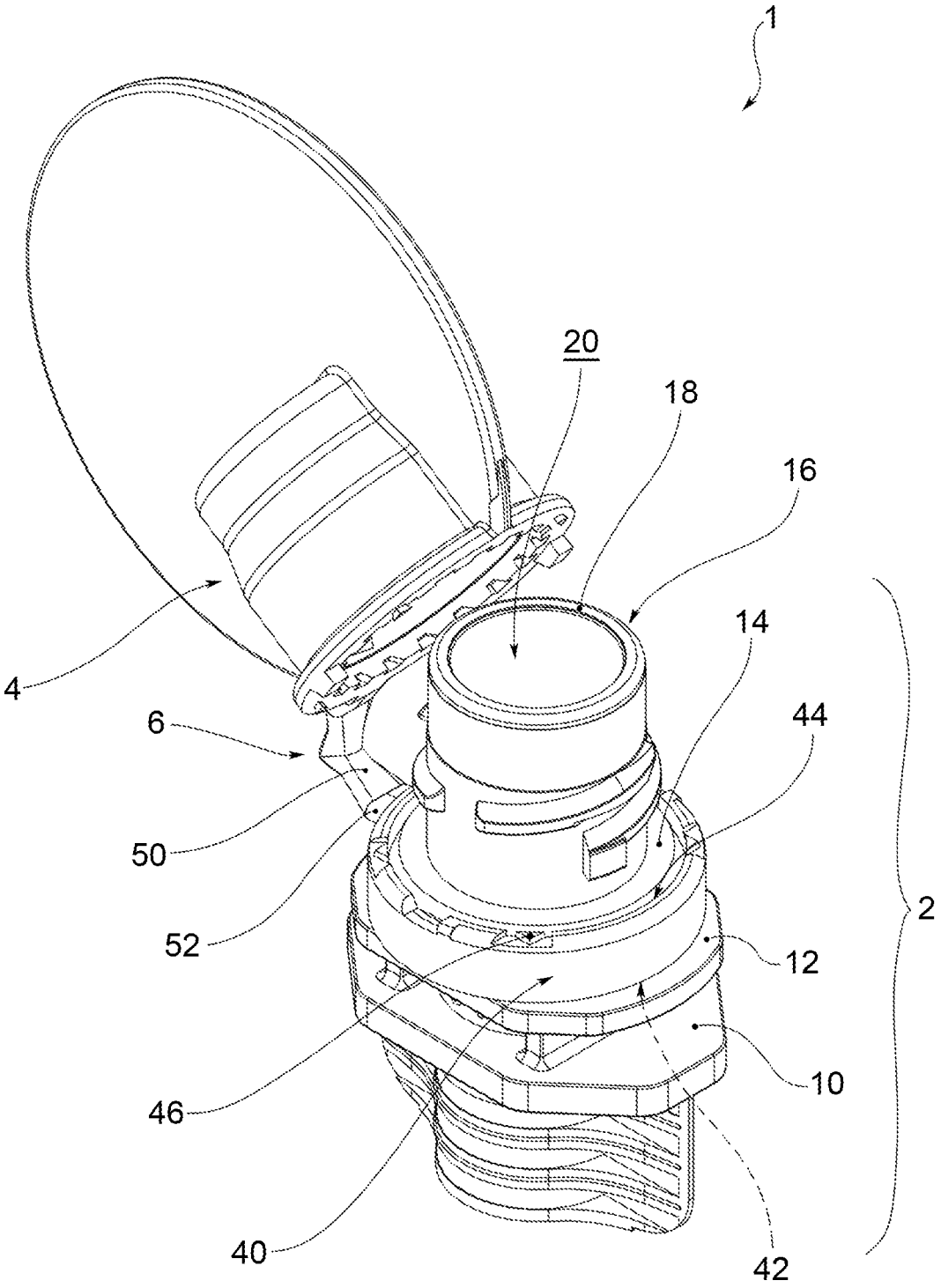
Figure 1C:
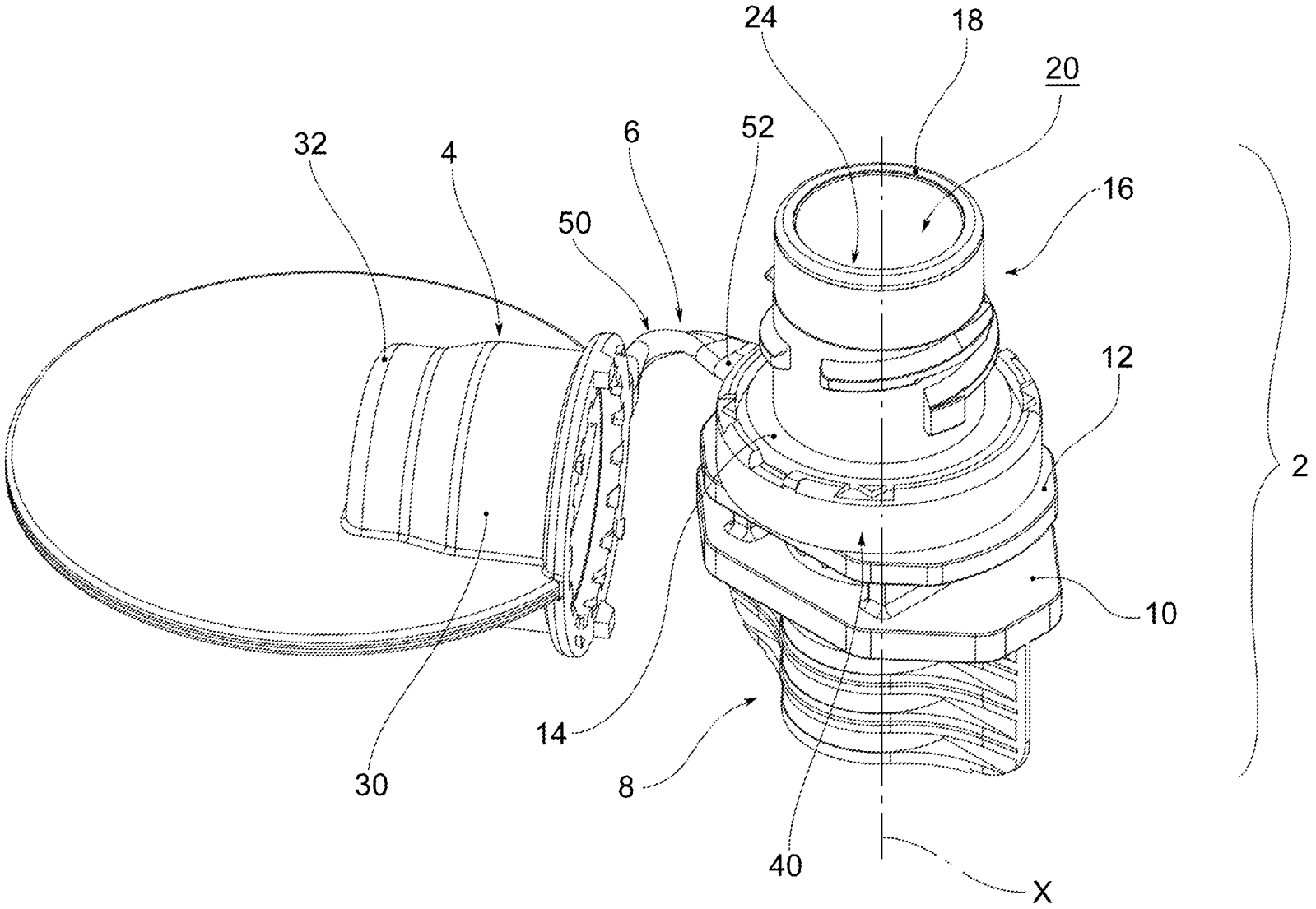
Figure 2A:
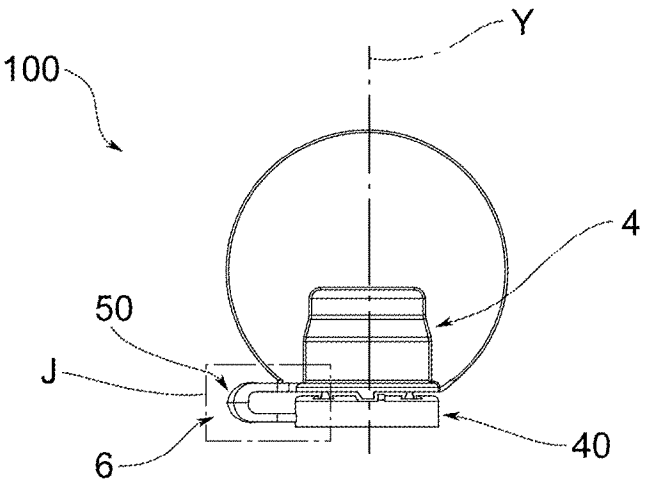
Figure 2B:
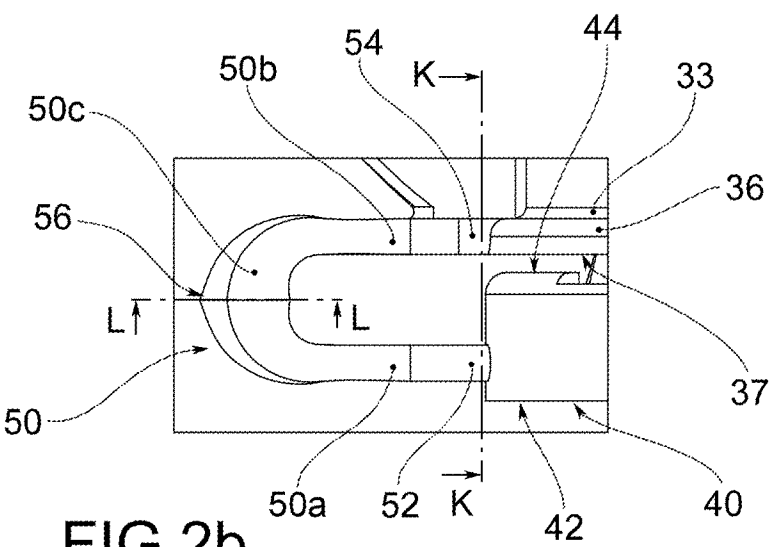
Figure 2C:
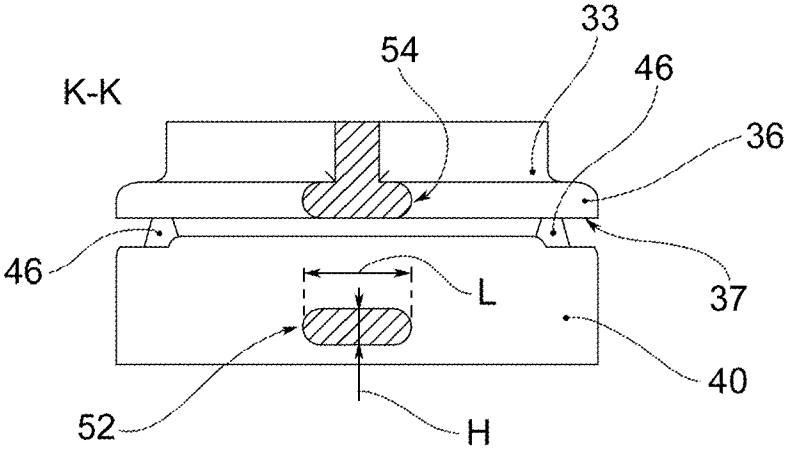
Figure 2D:
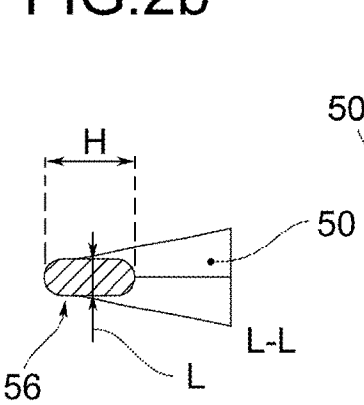
Figure 2E:
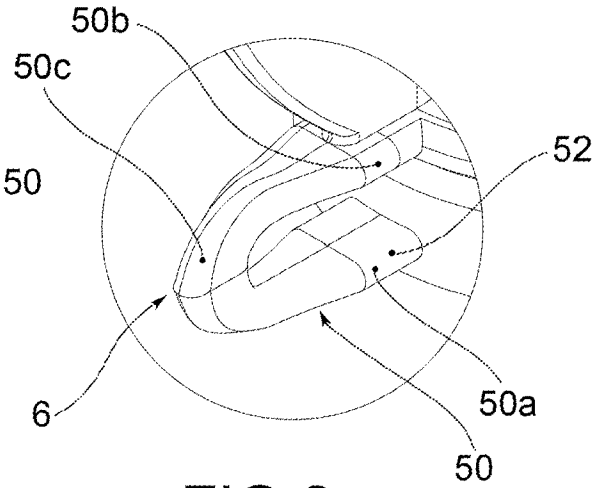
Figure 3A:
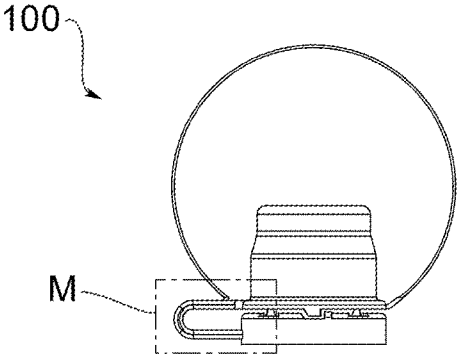
Figure 3B:
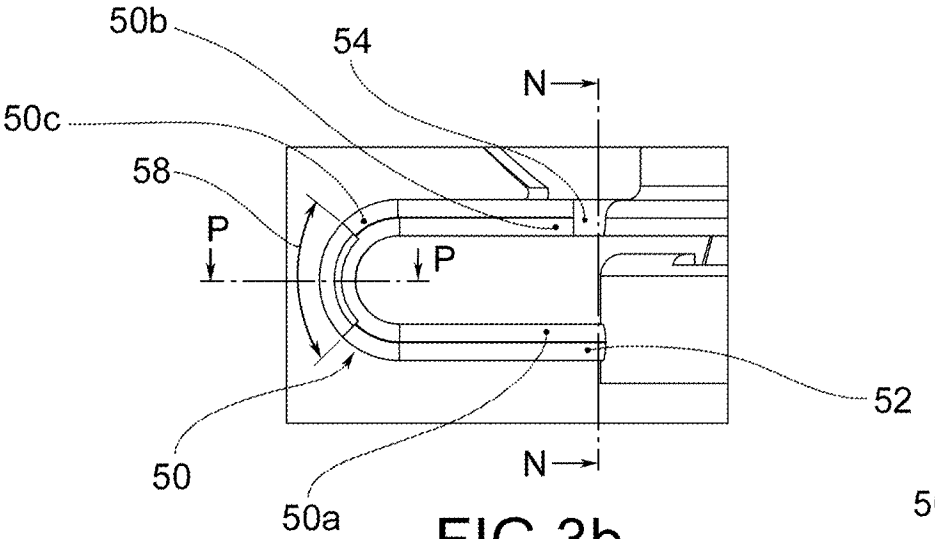
Figure 3C:
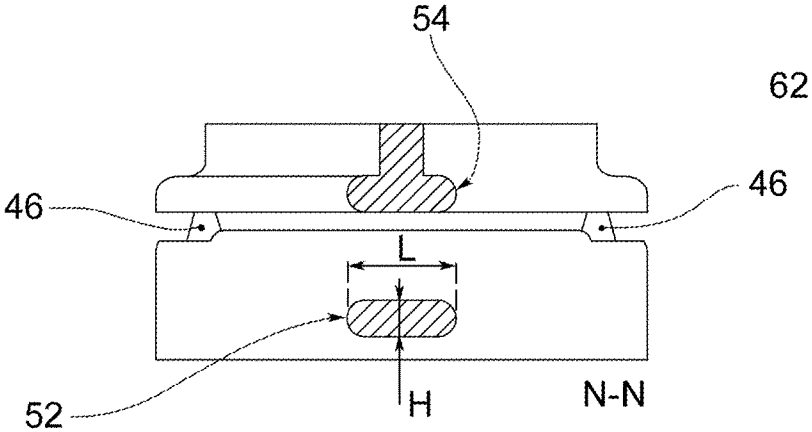
Figure 3D:
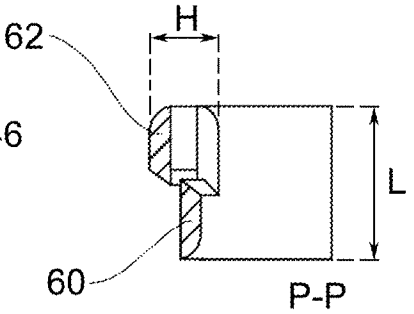
Figure 3E:
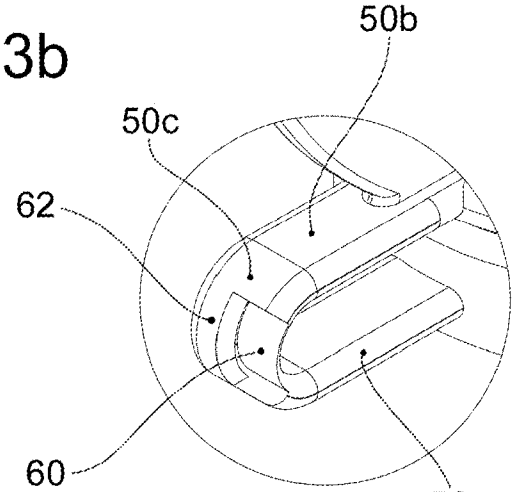

Furthermore, the configuration of the strap 50 is such as to facilitate the overturning of the cap 4 on one side of the tube 16 (FIG. 1*c*).

In other words, once the unscrewing is complete, the main Y axis of the cap 4 lies on an imaginary plane which also contains the main X axis of the tube 26 (FIG. 1*b*). Furthermore, the strap 50 accompanies the cap 4 overturning on one side of the tube 16 (FIG. 1*c*), for example so that the main axis Y of the cap 4 is incident on a plane passing through the main axis X of the tube 16.

By virtue of to the plastic yielding of at least a portion of the strap 50, once the overturned configuration is reached, the cap remains in said overturned configuration.

This greatly facilitates the use of the spout by the user.

According to a first embodiment of the invention (FIGS. 2*a* to 2*e*), the configuration of the strap 50 is such that at the ring end 52, said strap 50 has a cross section having a circumferential width or size L greater than the axial height or dimension H, for example equal to 3 mm circumferentially and 1 mm axially.

Preferably, the same occurs at the cap end 54.

Proceeding from the ring end 52 towards an intermediate region of the strap 50, the width L decreases and the height H increases, so that in a median section 56 of the length of the strap 50, the height H is greater than the width L, for example the height is equal to 3 millimeters and the width L to 1 millimeter.

According to a further embodiment (FIGS. 3*a* to 3*e*), the configuration of the strap 50 is such that at the ring end 52, said strap 50 has a cross section having a circumferential width or size L greater than the axial height or dimension H, for example equal to 3 mm circumferentially and 1 mm axially.

Preferably, the same occurs at the cap end 54.

An intermediate section 58 of the strap 50, preferably a median section, on the other hand has reduced sections, and in particular consists of a first branch 60 and a second branch 62, preferably separate, each having a width and height smaller than the width L and height H of the section of the ring end 52 (or of the cap end 54).

According to an even further embodiment (FIGS. 4*a* to 4*e*), the configuration of the strap 50 is such that at the ring end 52, said strap 50 has a substantially circular section, while at the cap end 54 said strap 50 has a cross section having a circumferential width or dimension L greater than the axial height or dimension H.

In an intermediate section 64, for example in a median section, the section is reduced by at least one notch 66, so that said intermediate section 64 consists of a branch 68 with a reduced section.

In an even further embodiment (FIGS. 5*a* to 5*e*), the strap 50 has a configuration such that a cross section at the ring end 52 has a prevalent extension along a ring section direction K inclined with respect to a horizontal reference plane P, for example defined by an imaginary plane supporting the ring 40.

The cross section at the cap end 54, on the other hand, preferably has a prevalent extension along a cap section direction J substantially parallel to said horizontal plane P.

Figure 6:
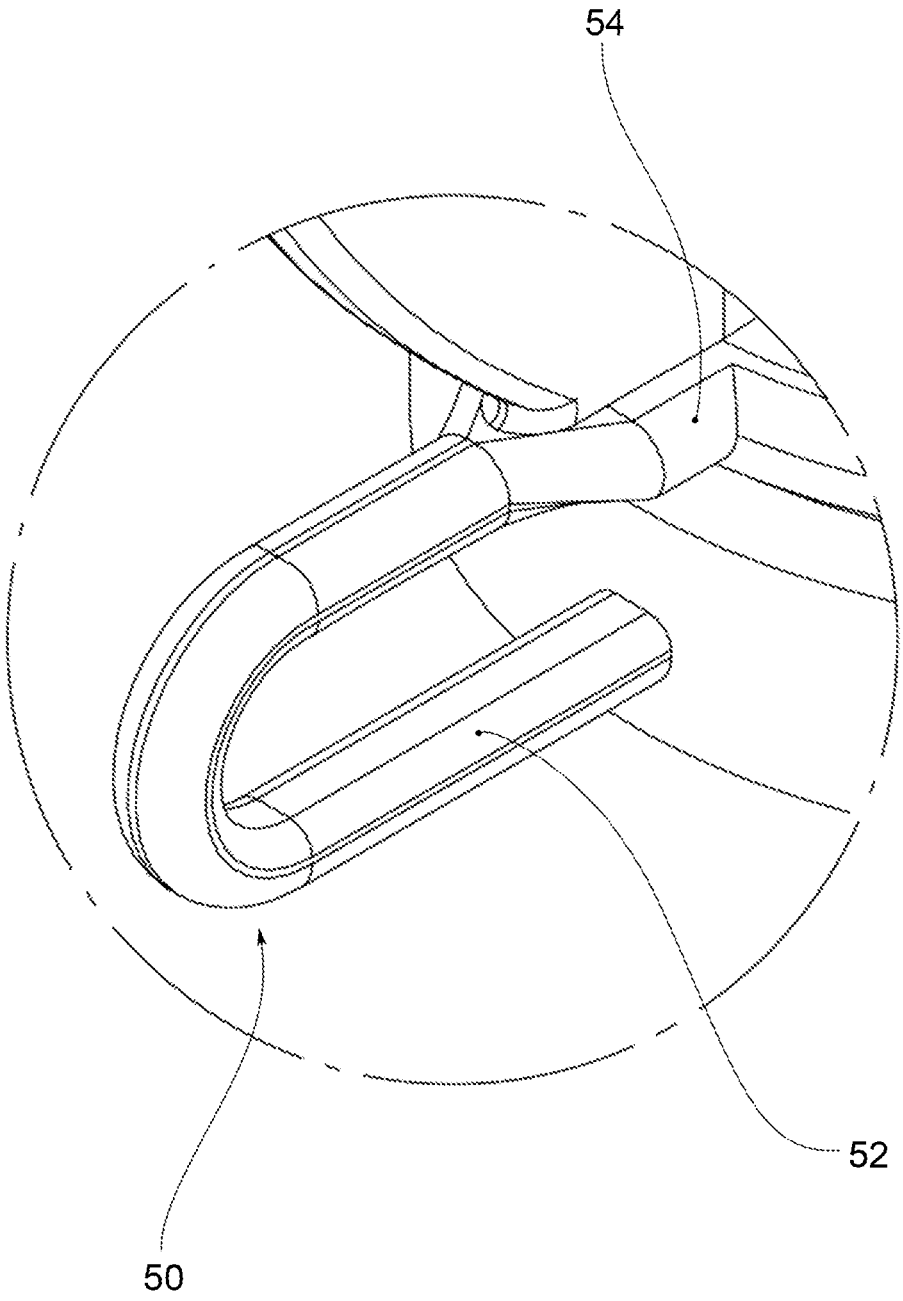
FIG. 6 shows a strap of a closing assembly according to an even further embodiment of the invention.
Figure 7:
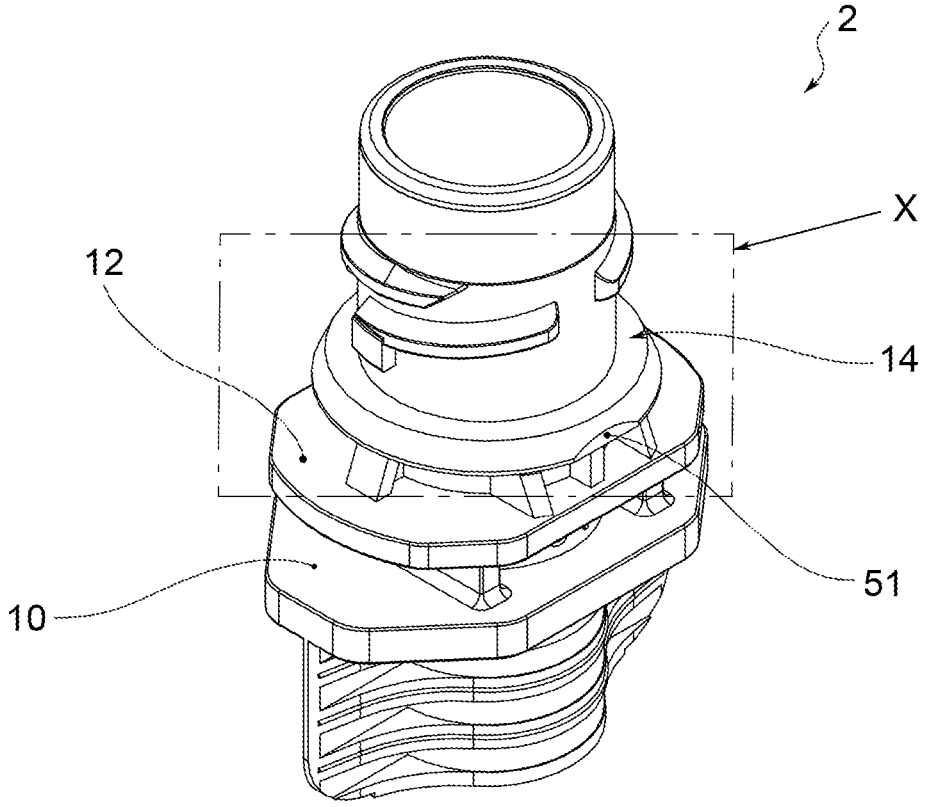
FIG. 7 shows a preferred embodiment of a spout according to the present invention.
Figure 10:
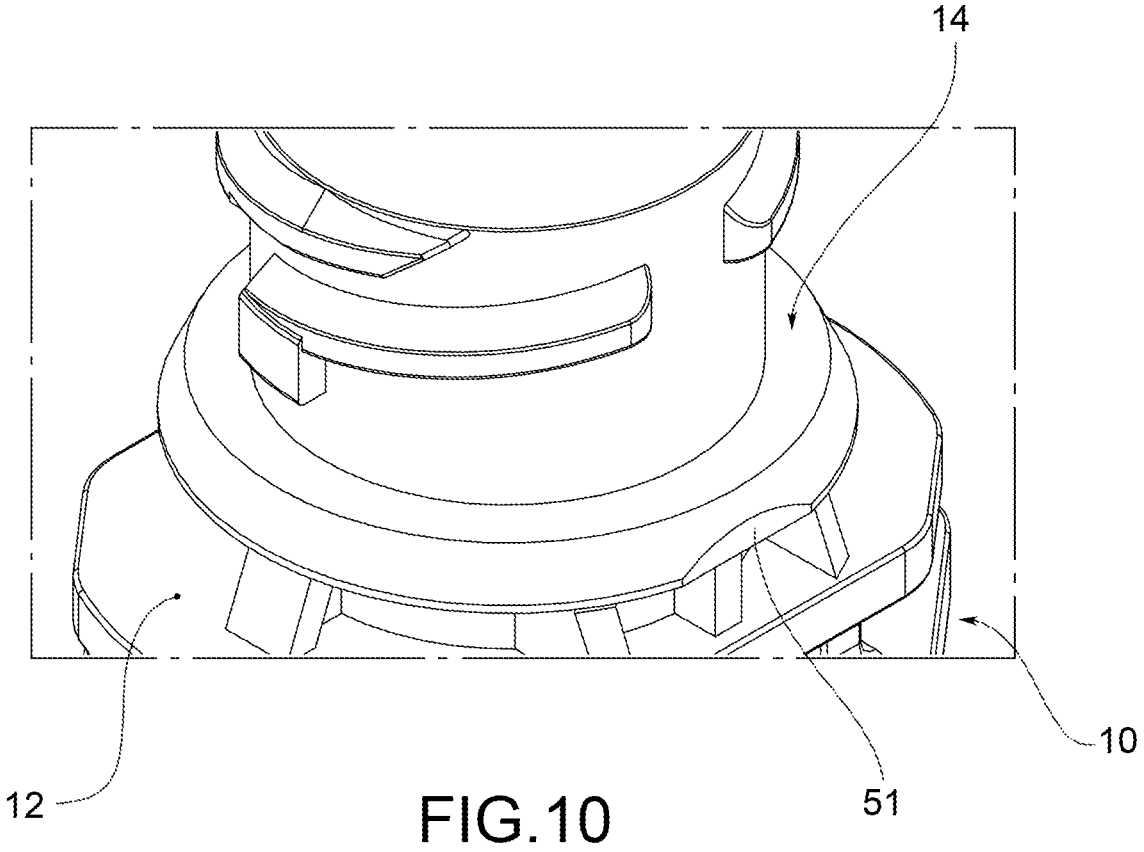
FIG. 10 is an enlargement of the box X in FIG. 7.
Figure 8:
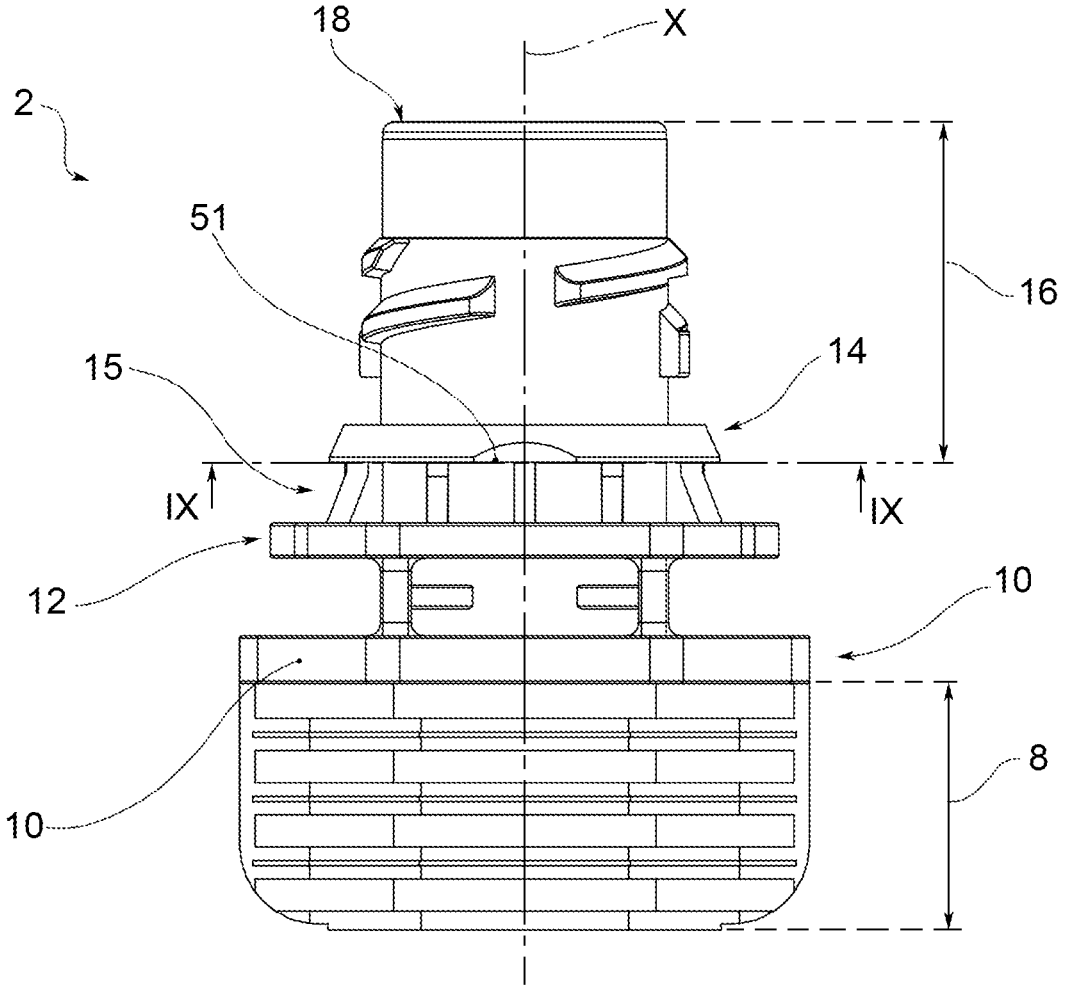
FIG. 8 shows a side view of the spout of FIG. 7.
Figure 9:
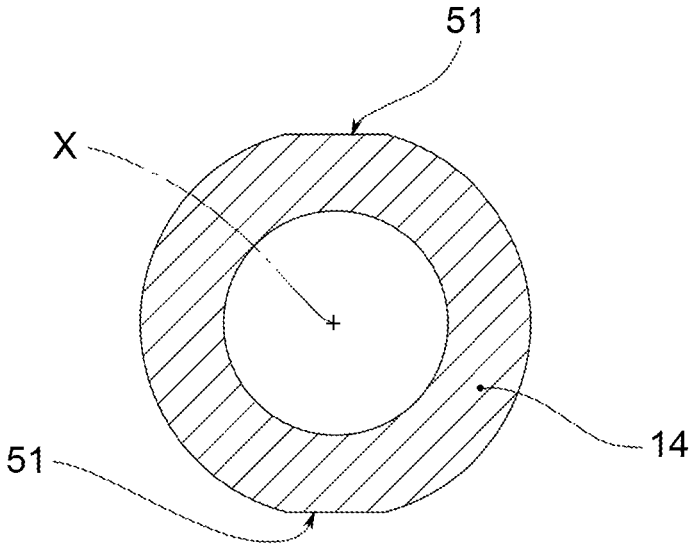
FIG. 9 shows a section of the spout according to the section plane IX-IX of FIG. 8.

According to an even further embodiment (FIG. 6), the strap 50 has a substantially circular cross section at the ring end 52, and said section remains constant in shape and size along the length of the strap. At the cap end 54, the section has a width greater than the height.

According to a further embodiment (FIGS. 14*a*, 14*b*, 14*c*), the ring 40 comprises an annular appendage 90, coaxial with the remaining part of the ring 40 and connected thereto by a flexible partition 92. The appendage 90 is therefore collapsible.

Figure 4B:
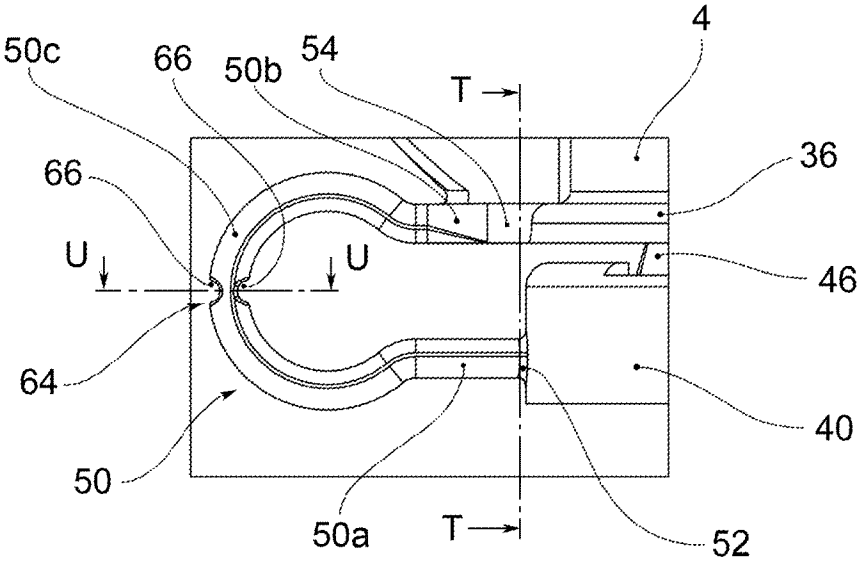
Figure 4E:
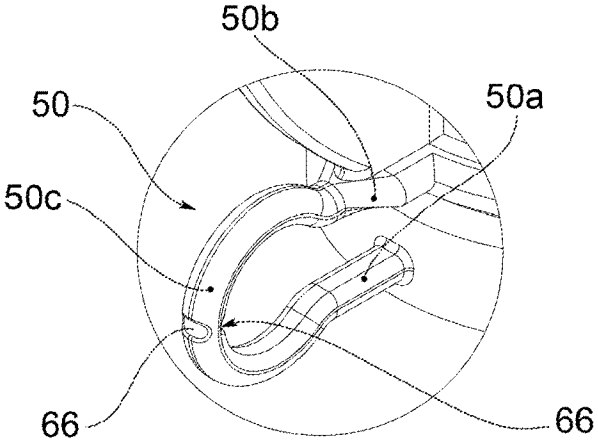
Figure 4D:
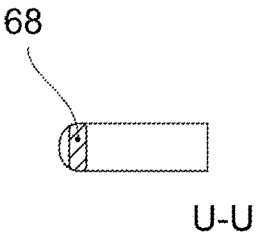
Figure 4A:
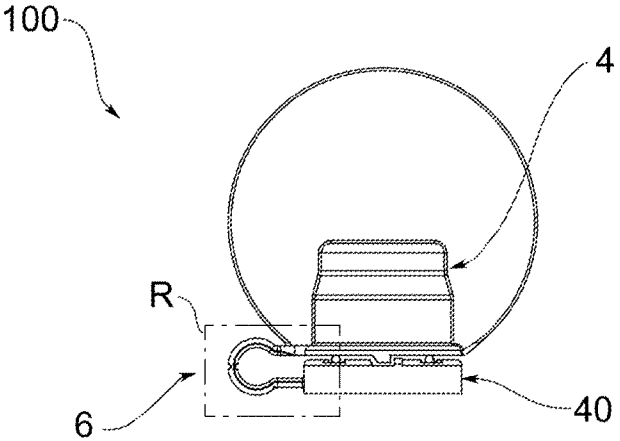
Figure 4C:
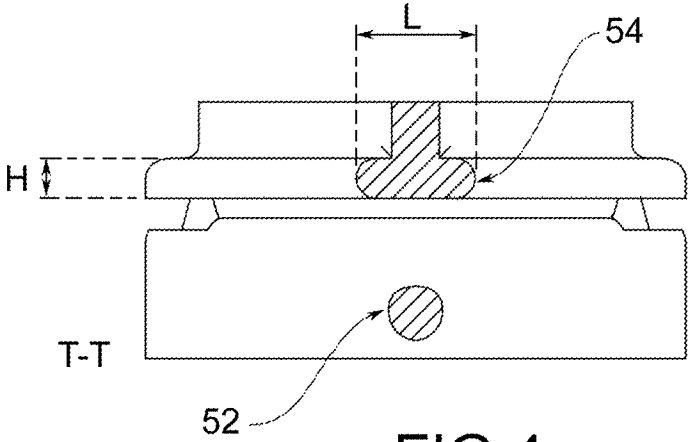
Figure 5A:
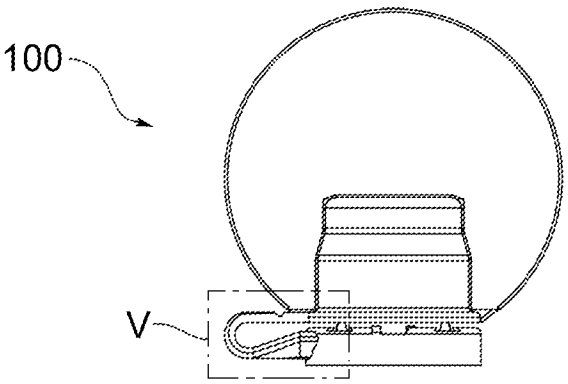
Figure 5B:
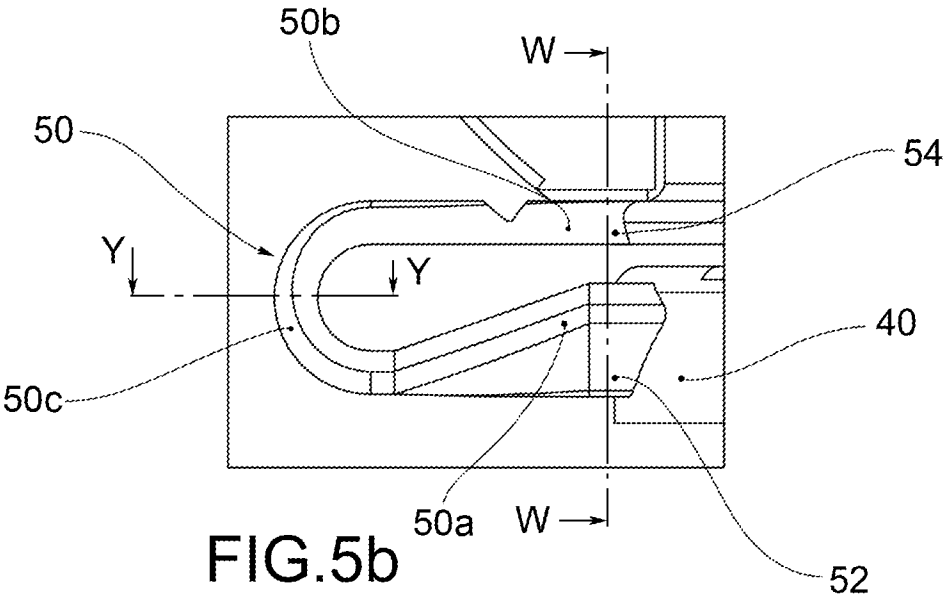
Figure 5C:
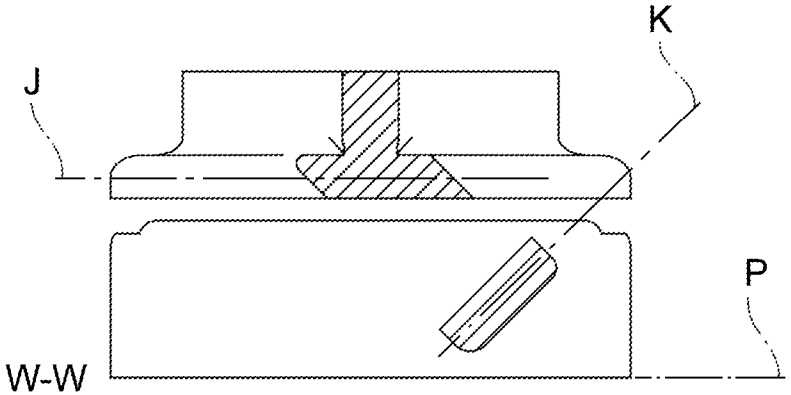
Figure 5D:
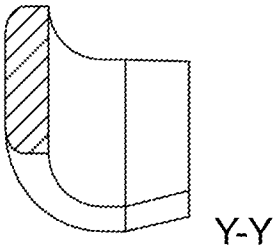
Figure 5E:
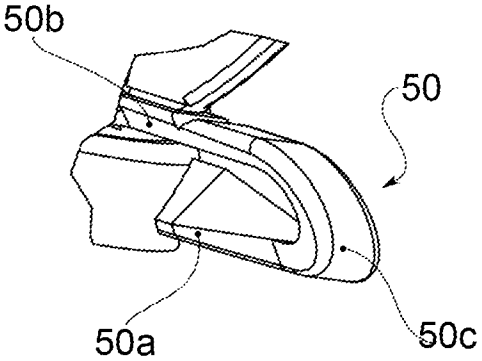

According to this embodiment, the ring 40 is produced by molding so that the appendage 90 protrudes inferiorly from the remaining part (FIG. 4*a*).

During application to the spout 2, the appendage 90 interferes with the upper flange 14, folds inwards and snaps into the connection seat 15.

Innovatively, the closing assembly according to the present invention overcomes the drawbacks mentioned above with reference to the prior art, since it allows the cap to be kept constrained to the spout, even when the cap is unscrewed.

Furthermore, advantageously, the use remains particularly easy, especially for children, since, once the cap has been unscrewed, overturning thereof is facilitated on one side of the tube of the spout, so as not to interfere with the use of the spout.

It is clear that a man skilled in the art may make changes to the closing assembly described above, all falling within the scope of protection as defined in the following claims.

The invention claimed is:

1. A spout assembly comprising:

a spout for a thin-walled flexible packaging, having a tube;

a closing assembly applicable to the spout, comprising:

a cap comprising:

an annular side wall, extending along a main axis between a lower edge and an upper edge, internally threaded, a base which closes it at the top, connected to the upper edge, and a cap flange, protruding radially externally from the side wall at the lower edge;

a connecting device comprising:

a connecting ring adapted to be axially constrained to the spout and freely rotatable about the tube of the spout, wherein said ring comprises an inner side surface and an outer side surface;

a plurality of breakable bridges joining the ring to the cap, suitable for tearing due to relative axial separation between the ring and the cap;

a connecting strap which joins the ring to the cap, wherein said strap has a predominant length with respect to the other dimensions, extends from a ring end joined to the outer side surface to a cap end joined to the cap and has, in an initial configuration in which the bridges are intact, a ring section projecting radially from the ring end, a cap section extending radially from the cap end, and a connection section which joins the cap section and the ring section;

wherein the spout has a connection seat to accommodate at least partially the ring, the connection seat being separated from the tube by an upper flange having a truncated cone-shaped outer lateral surface; and the inner side surface has an inner projection configured to snap-fit with the upper flange and enter the connection seat, wherein the inner projection has an axial height and a radial height and the ratio between the axial height and the radial height is between 2 and 5.

2. The spout assembly according to claim 1, wherein the the ratio between the axial height and the radial height is between 3 and 4 or equal to 3.5.

3. The spout assembly according to claim 1, wherein the upper flange has a maximum diameter $D_{max}$ and the inner projection has a minimum diameter $D_{min}$ and a ratio between the maximum diameter of the upper flange and the minimum diameter of the inner projection is between 0.9 and 1.2, or between 1.0 and 1.1, or equal to 1.05.

4. The spout assembly according to claim 1, wherein the inner projection has an annular chamfer surface, which creates a recess for the snap-on application of the ring in the connection seat, wherein the chamfer surface is truncated-cone and inclined by an angle with respect to an imaginary plane orthogonal to a central axis of the ring, wherein said angle is comprised between 40 and 50°, or between 44 and 46°, or equal to about 45°.

5. The spout assembly according to claim 1, wherein the upper flange has a chamfer surface for forming a recess for the snap-fit application of the ring in the connection seat, wherein said chamfer surface is truncated-cone and inclined by an angle with respect to an imaginary plane orthogonal to a main axis of the spout, wherein said angle is comprised between 60 and 70°, or between 63 and 67°, or equal to 65°.

6. The spout assembly according to claim 1, wherein the ring has a predefined height between an upper surface and a lower surface, the cap flange has a lower surface facing the upper surface of the ring, and said bridges join the upper surface of the ring to the lower surface of the cap flange.

7. The spout assembly according to claim 1, wherein the ring has an outer lateral surface, the cap flange has an outer lateral surface and said strap joins the outer lateral surface of the ring to the outer lateral surface of the cap flange.

8. The spout assembly according to claim 1, wherein the closing assembly is made of a single piece of plastic material by injection moulding.

9. The spout assembly according to claim 1, wherein said strap has a length such as to allow the cap to be overturned on one side of the tube of the spout.

10. The spout assembly according to claim 9, wherein at the ring end, said strap has a cross section having a circumferential width or dimension greater than the height or axial dimension.

11. The spout assembly according to claim 10, wherein proceeding from the ring end towards an intermediate region of the strap, the width decreases and the height increases.

12. The spout assembly according to claim 11, wherein in a median section along the length of the strap, the height is greater than the width.

13. The spout assembly according to claim 9, wherein at the ring end, said strap has a substantially circular section.

14. The spout assembly according to claim 13, wherein said circular section remains constant in shape and size along the length of the strap.

15. The spout assembly according to claim 9, wherein an intermediate section of the strap, or a middle section, consists of a first branch and a second branch, separated, each having a smaller width and height respectively of the width and of the height of the section of the ring end.

16. The spout assembly according to claim 15, wherein in an intermediate section in a middle section, the section is reduced by at least one notch.

17. The spout assembly according to claim 16, wherein a cross section of the strap at the ring end has a prevalent extension along a ring section direction inclined with respect to a horizontal reference plane defined by an imaginary plane supporting the ring.

18. The spout assembly according to claim 1, wherein the ring section of the strap is straight, the cap section is straight, and the joining section is arched.

19. The spout assembly according to claim 1, wherein the upper flange is mainly circular and has, on an outer lateral surface, a pair of flat and parallel facets, wherein each facet lies on an imaginary plane parallel to a main axis of the tube.

20. A thin-walled flexible packaging including:

a flexible bag provided with a front wall and a rear wall consisting of a thin film;

a spout assembly according to claim 1, wherein the spout comprises a connecting portion engaged between the edges of the front wall and the rear wall of the flexible bag.

* * * * *